US007764250B2

(12) United States Patent
Nishimura et al.

(10) Patent No.: US 7,764,250 B2
(45) Date of Patent: Jul. 27, 2010

(54) PLASMA DISPLAY DEVICE

(75) Inventors: Masaru Nishimura, Chuo (JP); Shigeru Iwaoka, Chuo (JP)

(73) Assignee: Panasonic Corporation, Osaka (JP)

( * ) Notice: Subject to any disclaimer, the term of this patent is extended or adjusted under 35 U.S.C. 154(b) by 713 days.

(21) Appl. No.: 11/333,555

(22) Filed: Jan. 18, 2006

(65) Prior Publication Data

US 2006/0175976 A1 Aug. 10, 2006

(30) Foreign Application Priority Data

Jan. 19, 2005 (JP) ..... 2005-011631

(51) Int. Cl.
*G09G 3/28* (2006.01)

(52) U.S. Cl. ..... 345/67; 345/60; 315/169.2; 315/169.3; 315/169.4; 313/586

(58) Field of Classification Search ..... 345/60, 345/68, 67; 315/169.2, 169.3, 169.4; 313/586
See application file for complete search history.

(56) References Cited

U.S. PATENT DOCUMENTS

| | | | | |
|---|---|---|---|---|
| 6,486,611 | B2 * | 11/2002 | Tokunaga et al. | 315/169.4 |
| 7,205,165 | B1 * | 4/2007 | Salman et al. | 438/10 |
| 7,274,344 | B2 * | 9/2007 | Lacoste et al. | 345/68 |
| 7,323,818 | B2 * | 1/2008 | Kwon et al. | 313/584 |
| 7,333,076 | B2 * | 2/2008 | Nakamura et al. | 345/60 |
| 7,375,703 | B2 | 5/2008 | Jeong | |
| 2004/0075388 | A1 * | 4/2004 | Miyashita et al. | 313/586 |

FOREIGN PATENT DOCUMENTS

| | | |
|---|---|---|
| CN | 1504983 | 6/2004 |
| CN | 1523633 | 8/2004 |
| CN | 1551072 | 12/2004 |
| EP | 1 298 694 | 4/2003 |
| EP | 1 489 586 | 12/2004 |
| EP | 1 580 786 | 9/2005 |
| EP | 1 681 665 | 7/2006 |

(Continued)

OTHER PUBLICATIONS

Saksena et al. Cathodo-Luminescence of MgO, Jun. 8, 1954, National Physical Laboratory of India, New Delhi, India, pp. 814-815.*

(Continued)

*Primary Examiner*—Henry N Tran
*Assistant Examiner*—Viet Pham
(74) *Attorney, Agent, or Firm*—Drinker Biddle & Reath LLP

(57) ABSTRACT

A plasma display device which comprises a magnesium oxide layer formed on a plane in contact with the discharge space in each display cell of a plasma display panel, having magnesium oxide crystals that perform cathode luminescence light emission with a peak in a wavelength band of 200 to 300 nm as a result of excitation caused by electron-beam irradiation. Each of the display cells is set in a lit cell state or an unlit cell state by selectively inducing an address discharge, and only the display cells set in the lit cell state are caused to perform a sustain discharge by applying a sustain pulse after the selective scanning has ended.

10 Claims, 9 Drawing Sheets

CROSS - SECTION ALONG V3 - V3

FOREIGN PATENT DOCUMENTS

| | | |
|---|---|---|
| JP | 7-192630 | 7/1995 |
| JP | 08-22772 | 1/1996 |
| JP | 11-065517 | 3/1999 |
| JP | 2004-176400 | 6/2001 |
| JP | 2002-56779 | 2/2002 |
| JP | 2004-38161 | 2/2004 |
| JP | 2004-77644 | 3/2004 |
| JP | 2004-157291 | 6/2004 |
| JP | 2006-54160 | 2/2006 |
| WO | WO 03/075314 | 9/2003 |

OTHER PUBLICATIONS

Grant et al. ("Time resolved luminescence spectroscopy of alkaline earth oxides after pulsed electron beam irradiation. II. Spectra and thresholds of MgO", J. Chem. Phys. 90 (1989) 807).*

* cited by examiner

CROSS - SECTION ALONG V3 - V3

CROSS - SECTION ALONG W2 - W2

PLASMA DISPLAY DEVICE

BACKGROUND OF THE INVENTION

1. Field of the Invention

The present invention relates to a plasma display device using a plasma display panel.

2. Description of the Related Background Art

A plasma display device includes a plasma display panel which has a plurality of display cells corresponding to pixels, respectively. The plasma display device renders a grayscale display by constituting one field (or one frame) of an image signal by means of a plurality of subfields each of which includes an address period and a sustain period as a period of time. In the address period, either one of a lit mode state where wall electric charge exists and an unlit mode state where wall electric charge does not exist is set by causing each of the display cells of the plasma display panel to be selectively discharged on the basis of an input image signal. Further, in the sustain period, only the display cells that have been set in the lit mode state are allowed to retain the light-emitting state in which a sustain discharge is repetitively performed by the number of times corresponding to the weight of each of the subfields.

Further, a reset period for initializing the states of all the display cells is provided immediately before the address period of each of the subfields. In the reset period, first a write reset discharge for forming wall electric charge in all the display cells is induced and, by successively inducing an erase reset discharge for erasing the wall electric charge formed in all the display cells, all the display cells are initialized in an erase mode state. However, since light emission accompanying the reset discharge is not involved in the display image according to the input image signal and is induced all together in all the display cells, the contrast of the display image and, in particular, the dark contrast while displaying an image representing a dark scene drops. Therefore, a drive method for suppressing a drop in contrast by setting the number of reset discharges in the display period of one field (or one frame) as only one has been proposed (Japanese Patent Application Kokai No. H11-65517, for example).

When the number of reset discharges is set at only one, discharge delay occurs in the various discharges in subsequent address period and sustain period. Thus, it is necessary to widen the pulse width of each drive pulse that is applied to the plasma display panel to induce the various discharges. However, since the address period and sustain period are respectively made longer in accordance with the widening portion of the pulse width, there has been the problem that it is difficult to increase the number of display grayscales by increasing the number of subfields.

SUMMARY OF THE INVENTION

An object of the present invention is to provide a plasma display device that can increase the number of display grayscales.

A plasma display device according to the present invention is a plasma display device equipped with a plasma display panel having a plurality of row electrode pairs constituting a plurality of display lines and a plurality of column electrodes that intersect with each of the row electrode pairs so as to form display cells each having a discharge space at the intersection portions, comprising: a magnesium oxide layer formed on a plane in contact with the discharge space in each of the display cells, having magnesium oxide crystals that perform cathode luminescence light emission with a peak in a wavelength band of 200 to 300 nm as a result of excitation caused by electron-beam irradiation; an address portion which sets the display cells in a lit cell state or an unlit cell state by selectively inducing an address discharge in each of the display cells by applying a scan pulse to one row electrode of each of the row electrode pairs in turn and by applying a pixel data pulse to the column electrode in accordance with pixel data based on an image signal; and a sustain portion which allows only the display cells set in the lit cell state to execute a sustain discharge by applying a sustain pulse to each of the row electrode pairs after the selective scanning of some of the display lines or all of the display lines by the address portion has ended.

DETAILED DESCRIPTION OF THE INVENTION

An embodiment of the present invention will be described in detail hereinbelow with reference to the drawings.

Figure 1:
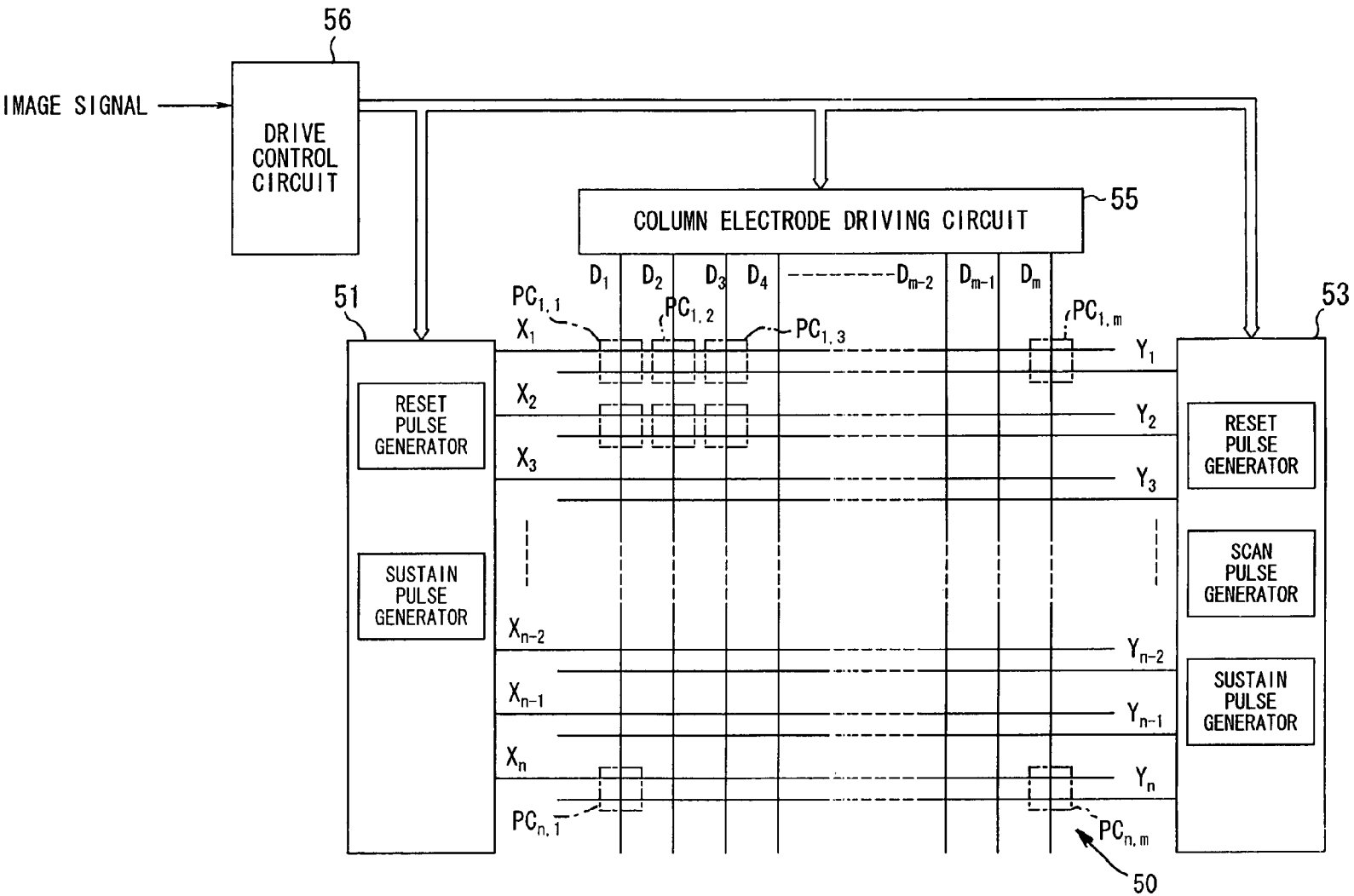
FIG. 1 is a diagram generally showing the configuration of a plasma display device according to the present invention.

FIG. 1 is a diagram generally showing the configuration of a plasma display device according to the present invention.

As shown in FIG. 1, the plasma display device comprises a PDP 50 as a plasma display panel, an X-row electrode driving circuit 51, a Y-row electrode driving circuit 53, a column electrode driving circuit 55, and a driving control circuit 56.

The PDP 50 is formed with column electrodes $D_1$ to $D_m$ respectively extending in a vertical direction of a two-dimensional display screen, and row electrodes $X_1$ to $X_n$ and row electrodes $Y_1$ to $Y_n$ respectively extending in the horizontal direction of the two-dimensional display screen. In this event, row electrode pairs $(Y_1, X_1)$, $(Y_2, X_2)$, $(Y_3, X_3)$, . . . , $(Y_n, X_n)$, which form pairs with adjacent ones to each other, form a first display line to an n-th display line on the PDP 50. At the intersection of each display line with each of the column electrodes $D_1$ to $D_m$ (an area surrounded by a one-dot chain line in FIG. 1), a display cell PC is formed to serve as a pixel. In other words, on the PDP 50, display cells $PC_{1,1}$ to $PC_{1,m}$ belonging to the first display line, display cells $PC_{2,1}$ to $PC_{2,m}$ belonging to the second display line, . . . , display cells $PC_{n,1}$ to $PC_{n,m}$ belonging to the n-th display line are arranged in a matrix form.

Each of the column electrodes $D_1$ to $D_m$, row electrodes $X_1$ to $X_n$, and row electrodes $Y_1$ to $Y_n$ is formed with a terminal t, such that each of the column electrodes $D_1$ to $D_m$ is connected to the column electrode driving circuit 55 through the terminal t thereof; each of the row electrodes $X_1$ to $X_n$ is connected to the X-row electrode driving circuit 51 through the terminal t thereof; and each of the row electrodes $Y_1$ to $Y_n$ is connected to the Y-row electrode driving circuit 53 through the terminal t thereof.

Figure 2:
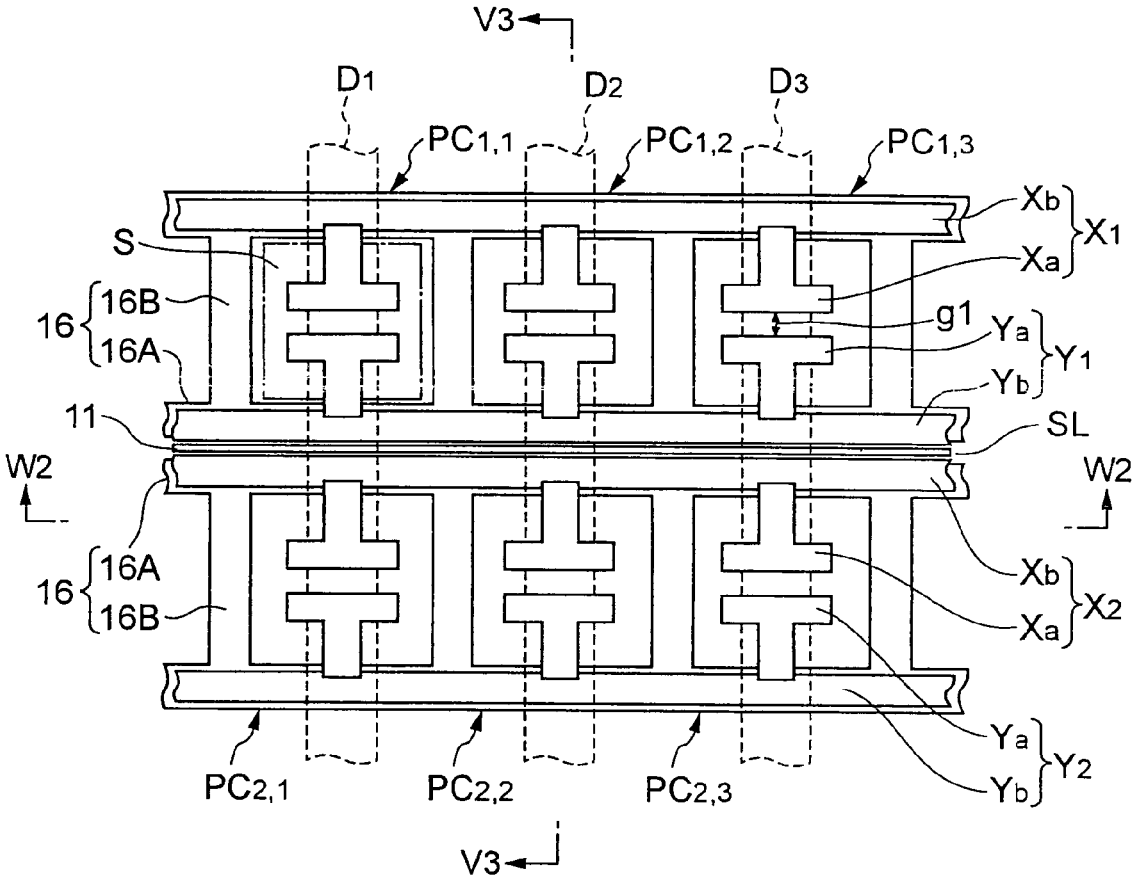
FIG. 2 is a front view schematically showing the internal structure of the PDP when viewed from a display screen side of the device in FIG. 1.
Figure 3:
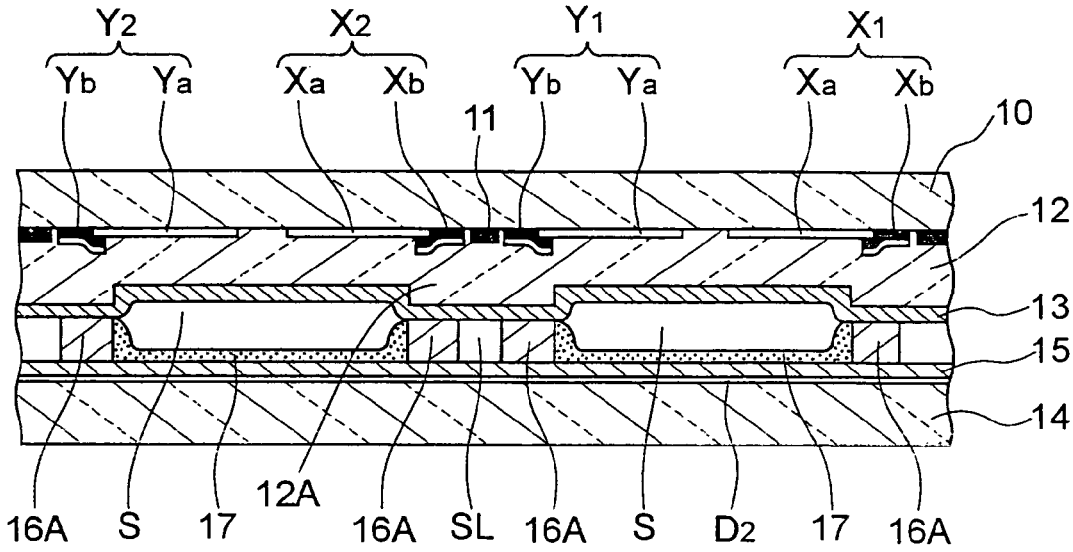
FIG. 3 is a diagram showing a cross-sectional view taken along a V3-V3 line shown in FIG. 2.
Figure 4:
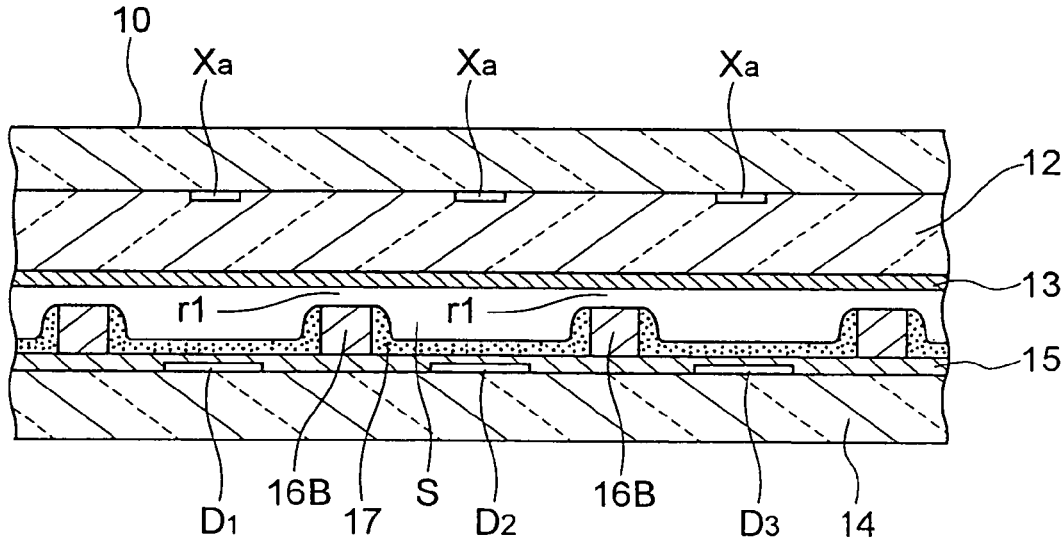
FIG. 4 is a diagram showing a cross sectional view taken along a W2-W2 line shown in FIG. 2.

FIG. 2 is a front view schematically showing the internal structure of the PDP 50 when viewed from the display surface side. In FIG. 2, intersections of each of the column electrodes $D_1$ to $D_3$ to the first display line $(Y_1, X_1)$ and second display line $(Y_2, X_2)$ are extracted for illustration. FIG. 3 is a cross-sectional view of the PDP 50 taken along a V3-V3 line in FIG. 2, and FIG. 4 is a cross-sectional view of the PDP 50 taken along a line W2-W2 in FIG. 2.

As shown in FIG. 2, each row electrode X is comprised of a bus electrode (main body section) Xb extending in the horizontal direction of the two-dimensional display screen, and a T-shaped transparent electrode (protruding section) Xa arranged in contact with a position corresponding to each display cell PC on the bus electrode Xb. Each row electrode Y is comprised of a bus electrode (main body section) Yb extending in the horizontal direction of the tow-dimensional display screen, and a T-shaped transparent electrode (protruding section) Ya arranged in contact with a position corresponding to each display cell PC on the bus electrode Yb. The transparent electrodes Xa, Ya are made of an electrically conductive transparent film, for example, ITO or the like, while the bus electrodes Xa, Xb are made, for example, of a metal film. The row electrode X comprised of the transparent electrode Xa and bus electrode Xb, and the row electrode Y comprised of the transparent electrode Ya and bus electrode Yb are formed on the back side of a front transparent substrate, the front side of which is a display screen of the PDP 50, as shown in FIG. 3. In this structure, the transparent electrodes Xa, Ya in each row electrode pair (X, Y) extend toward the row electrode with which it forms a pair, and each have a wider section having a peak side and a narrow section for linking the wider section and the main body section. The peak sides of their wider sections face each other through a discharge gap g1 of a predetermined width. Also, on the back side of the front transparent substrate 10, a black or a dark light absorbing layer (light shielding layer) 11 is formed to extend in the horizontal direction of the two-dimensional display screen between the pair of row electrode $(X_1, Y_1)$ and the row-electrode pair $(X_2, Y_2)$ adjacent to this row electrode pair. Further, on the back side of the front transparent substrate 10, a dielectric layer 12 is formed to cover the row electrode pairs (X, Y). On the back side of the dielectric layer 12 (surface opposite to the surface in contact with the row electrode pairs), a raised dielectric layer 12A is formed in a portion corresponding to a region which is formed with the light absorbing layer 11 and the bus electrodes Xb, Yb adjacent to this light absorbing layer 11, as shown in FIG. 3. A magnesium oxide layer 13 including magnesium oxide crystals that perform cathode luminescence light emission having a peak in the wavelength band 200 to 300 nm (nano meters) as a result of excitation caused by electron-beam irradiation as described subsequently is formed on the surface of the dielectric layer 12 and the raised dielectric layer 12A.

On the back substrate 14 arranged in parallel with the front transparent substrate 10, each of the column electrodes D is formed to extend in a direction perpendicular to the row electrode pair (X, Y) at a position opposite to the transparent electrodes Xa, Ya in each row electrode pair (X, Y). On the back substrate 14, a white column electrode protection layer 15 is further formed for covering the column electrodes D. Partitions 16 are formed on the column electrode protection layer 15. The partitions 16 are formed in a ladder shape with a horizontal wall 16A extending in the horizontal direction on the two-dimensional display screen at a position corresponding to each of the bus electrodes Xb, Yb of each row electrode pair (X, Y), and a vertical wall 16B extending in the vertical direction on the two-dimensional display screen at each intermediate position between the column electrodes D adjacent to each other. For each display line, the partitions 16 are formed in a ladder shape as shown in FIG. 2, and a clearance SL as shown in FIG. 2 exists between the partitions 16 adjacent to each other. Also, the ladder-shaped partitions 16 define the display cells PC each including an independent discharge space S, and transparent electrodes Xa, Ya. The discharge space S is filled with a discharge gas including at least 10% by volume xenon gas. On a side surface of the horizontal wall 16A, a side surface of the vertical wall 16B, and the surface of the column electrode protection layer 15 in each display cell PC, a fluorescent material layer 17 is formed to cover these surfaces, as shown in FIG. 3. Actually, the fluorescent material layer 17 comprises three types of fluorescent materials for emitting red light, green light, and blue light. Between the discharge space S and the gap SL of each display cell PC, the horizontal wall 16A abuts to the magnesium oxide layer 13 to close each other, as shown in FIG. 3. On the other hand, as shown in FIG. 4, the magnesium oxide layer 13 does not abut to the vertical wall 16B, so that a gap r1 exists therebetween. In other words, the discharge spaces S of the display cells PC adjacent to each other in the horizontal direction on the two-dimensional display screen are in communication with one another through the gap r1.

Figure 6:
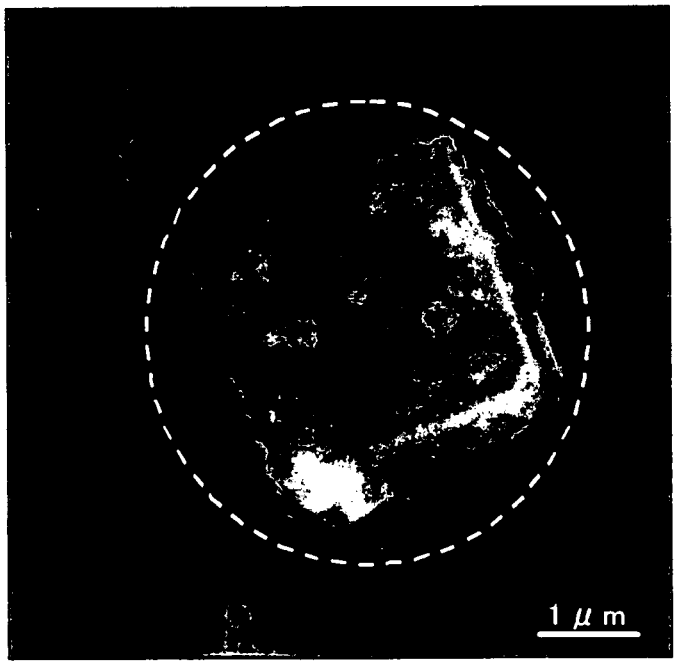
FIG. 6 is a diagram showing magnesium oxide single crystals having a cubic multiple crystal structure.
Figure 7:
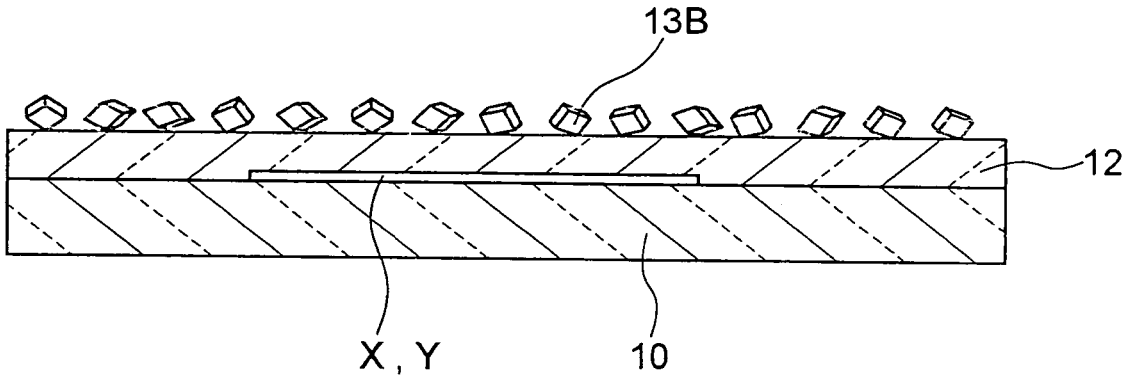
FIG. 7 is a diagram showing how a magnesium oxide single crystal powder is adhered to the surfaces of a dielectric layer and a raised dielectric layer to form a magnesium oxide layer.

Here, the magnesium oxide crystals, which form the magnesium oxide layer 13, include magnesium oxide crystals that are produced by heating magnesium to generate a magnesium vapor, and oxidizing the magnesium vapor in a vapor phase, for example, vapor-phase method magnesium crystals that are excited by an electron beam irradiated thereto to perform cathode luminescence light emission having a peak at a wavelength in a range of 200 to 300 nm (particularly, near 235 nm within 230-250 nm). The vapor-phase method magnesium oxide crystals include magnesium single crystals, the diameter of which is 2000 angstroms or more, have a multiple crystal structure in which solid crystals fit in each other, for example, as shown in a SEM photographed image in FIG. 5, or a solid single crystal structure as shown in a SEM photographed image in FIG. 6. The magnesium single crystals have the advantages of high purity, finer particulates, less aggregation of grains, and the like, as compared with magnesium oxide produced by another method, and contribute to improvements in the discharge characteristics such as a discharge delay, as will be later described. In this embodiment, the vapor-phase magnesium oxide single crystals used herein have an average grain diameter of 500 angstroms or more, and preferably 2000 angstroms or more, as measured by the BET method. Then, as shown in FIG. 7, the magnesium oxide single crystals are applied on the surface of the dielectric layer 12 by a spraying method, an electrostatic coating method or the like to form the magnesium oxide layer 13. Alternatively, a thin-film magnesium oxide layer may be formed on the surface of the dielectric layer 12 by vapor deposition or a sputtering method, and vapor-phase method magnesium oxide single crystals may be applied on the thin film magnesium oxide layer to form the magnesium oxide layer 13.

Figure 8:
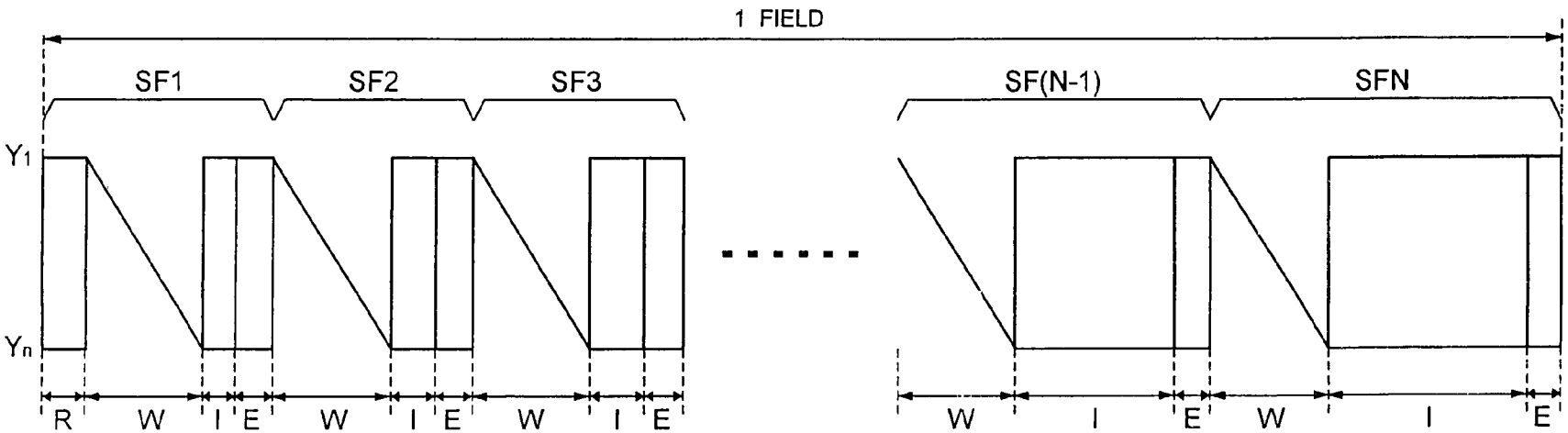
FIG. 8 is a diagram showing an exemplary light emission driving sequence employed in the plasma display device shown in FIG. 1.

The driving control circuit 56 supplies each of the X-row electrode driving circuit 51, Y-row electrode driving circuit 53, and column electrode driving circuit 55 with a variety of control signals for driving the PDP 50 having the foregoing structure in accordance with a light emission driving sequence which employs a subfield method (subframe method) as shown in FIG. 8. Further, in the light emission driving sequence shown in FIG. 8, one field (one frame) has N subfields SF1 to SF(N) in each of which an address stage W, a sustain stage I, and an erase stage E are sequentially executed. However, a reset stage R is executed prior to the address stage W only in the beginning subfield SF1.

The X-row electrode driving circuit 51 includes a reset pulse generator and a sustain pulse generator. The reset pulse generator of the X-row electrode driving circuit 51 generates a reset pulse (described subsequently) that is to be applied to the row electrodes X of the PDP 50 in the reset stage R. The sustain pulse generator of the X-row electrode driving circuit 51 generates a sustain pulse (described subsequently) that is to be applied to the row electrodes X in the sustain stage I.

The Y-row electrode driving circuit 53 includes a reset pulse generator, a scan pulse generator, and a sustain pulse generator. The reset pulse generator of the Y-row electrode driving circuit 53 generates a reset pulse (described subsequently) that is to be applied to the row electrodes Y of the PDP 50 in the reset stage R. The scan pulse generator of the Y-row electrode driving circuit 53 generates a scan pulse of a negative polarity that is to be applied to the row electrodes Y of the PDP 50 in the address stage W. The sustain pulse generator of the Y-row electrode driving circuit 53 generates a sustain pulse (described subsequently) that is to be applied to the row electrodes Y in the sustain stage I.

The column electrode driver circuit 55 generates a pixel data pulse that is to be applied to the column electrodes D of the PDP 50 in the address stage W.

Figure 9:
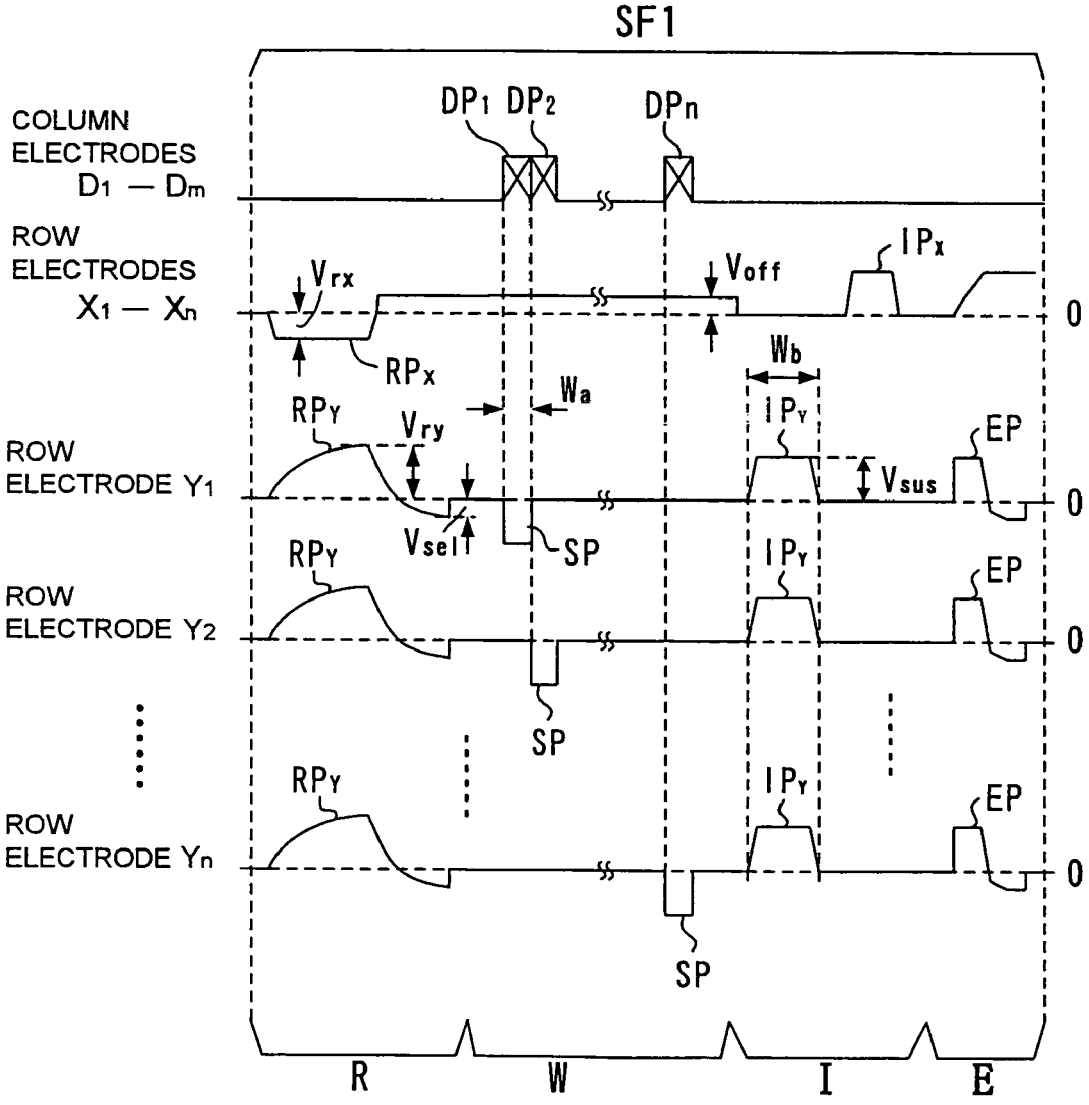
FIG. 9 is a diagram showing a variety of driving pulses applied to the PDP in accordance with the light emission driving sequence, and timings at which the pulses are applied.

FIG. 9 shows the application timing of various drive pulses that are applied to the column electrodes D and the row electrodes X and Y of the PDP 50 by taking SF1 as an excerpt from among the subfields SF1 to SF(N), First, in the reset stage R, the Y-row electrode driving circuit 53 applies a reset pulse $RP_Y$ having a leading edge portion in which the voltage on the row electrodes Y gradually increases as time elapses and reaches a peak voltage value Vry of a positive polarity and then a trailing edge portion in which the voltage value gradually decreases and reaches a voltage value Vsel of a negative polarity to the row electrodes $Y_1$ to $Y_n$ as shown in FIG. 9. Further, the voltage value Vsel is a voltage between the voltage value on the row electrodes Y when the scan pulse of a negative polarity is applied and a voltage value on the row electrodes Y when the voltage application has not been executed entirely. Further, the peak voltage value Vry is a voltage value that is higher than the voltage value on the row electrodes Y when a sustain pulse that will be described subsequently is applied. The X-row electrode driving circuit 51 applies a reset pulse $RP_X$ with a voltage Vrx of a negative polarity to the row electrodes $X_1$ to $X_n$ during the course of the increasing stage of the voltage value of the reset pulse $RP_Y$, as shown in FIG. 9.

Here, while the reset pulse $RP_X$ is applied together with the reset pulse $RP_Y$, a weak writing reset discharge is induced across the row electrodes X and Y in all the display cells $PC_{1,1}$ to $PC_{n,m}$ respectively. After this writing reset discharge has just ended, a predetermined amount of wall electric charge is formed on the surface of the magnesium oxide layer 13 in the discharge space S of each of the display cells PC. That is, the result is a state where so-called wall electric charge is formed in which charge of a positive polarity is formed in the vicinity of the row electrodes X on the surface of the magnesium oxide layer 13 and charge of a negative polarity is formed in the vicinity of the row electrodes Y. Thereafter, when the voltage of the reset pulse $RP_Y$ gradually drops from the peak voltage value Vry, over this period a weak erase reset discharge is induced across the row electrodes X and Y in all of the display cells $PC_{1,1}$ to $PC_{n,m}$ respectively. As a result of the erase reset discharge, the wall electric charge that has formed in all of the display cells $PC_{1,1}$ to $PC_{n,m}$ is eliminated. That is, as a result of the reset stage R, all of the display cells $PC_{1,1}$, to $PC_{n,m}$ are initialized in a so-called unlit mode state in which the amount of wall electric charge is less than the predetermined amount.

Thereafter, in the address stage W, the column electrode driver circuit 55 generates a pixel data pulse for setting whether to cause each of the display cells PC to emit light in the subfields on the basis of the input image signal. For example, the column electrode driver circuit 55 generates a high-voltage pixel data pulse for each of the display cells PC when the display cells PC are made to emit light and a low-voltage pixel data pulse when the display cells PC are not made to emit light. Further, the column electrode driver circuit 55 sequentially applies this pixel data pulse to the column electrodes $D_1$ to $D_m$ as the pixel data pulse group $DP_1$, $DP_2, \ldots, DP_n$ every one display lines (m). In this application period, the Y-row electrode driving circuit 53 sequentially applies a scan pulse SP of a negative polarity to the row electrodes $Y_1$ to $Y_n$ in sync with the timing of each of the pixel data pulse group $DP_1$ to $DP_n$. The pulse width of the scan pulse SP is less than 1 μsec. An address discharge is selectively induced in only the display cells PC to which the scan pulse SP is applied and to which a high-voltage pixel data pulse is applied, whereby a predetermined amount of wall electric charge is formed on the surface of each of the magnesium oxide layer 13 and fluorescent material layer 17 in the discharge space S of the display cells PC. On the other hand, an address discharge is not induced as above in the display cells PC to which the scan pulse SP is applied but to which a low-voltage pixel data pulse is applied, and, therefore, the previous wall electric charge formation state is maintained. That is, as a result of the execution of the address stage W, each of the display cells PC is set in either one of the lit mode state where the predetermined amount of wall electric charge exists or an unlit mode state where the predetermined amount of wall electric charge does not exist on the basis of the input image signal.

Thereafter, in the sustain stage I, each of the X-row electrode driving circuit 51 and Y-row electrode driving circuit 53 alternately applies positive sustain pulses $IP_X$ and $IP_Y$ repeatedly to the row electrodes $X_1$ to $X_n$ and $Y_1$ to $Y_n$. The number of times the sustain pulses $IP_X$ and $IP_Y$ are applied depends on the brightness weighting of each subfield. Here, for each time the sustain pulses $IP_X$ and $IP_Y$ are applied, only the display cells PC that have been set in the lit mode state where the predetermined amount of wall electric charge is formed perform a sustain discharge, the fluorescent material layer 17 emits light in accordance with the discharge, and an image is formed on the surface of the panel 50.

Thereafter, in the erase stage E, the Y-row electrode driving circuit 53 applies a positive erase pulse EP to all the row electrodes $Y_1$ to $Y_n$. As a result of applying this erase pulse EP, an erase discharge is induced in all of the display cells PC and all the wall electric charge remaining in the display cells PC is eliminated.

Figure 5:
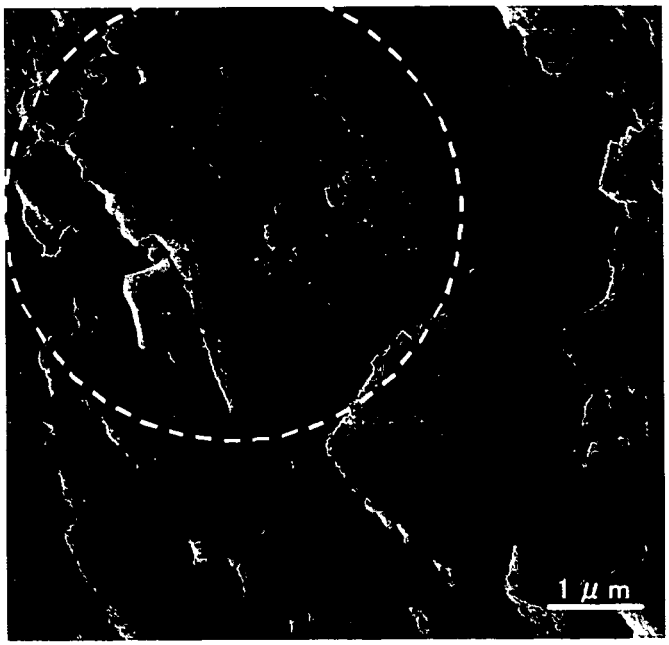
FIG. 5 is a diagram showing magnesium oxide single crystals having a cubic multiple crystal structure.
Figure 10:
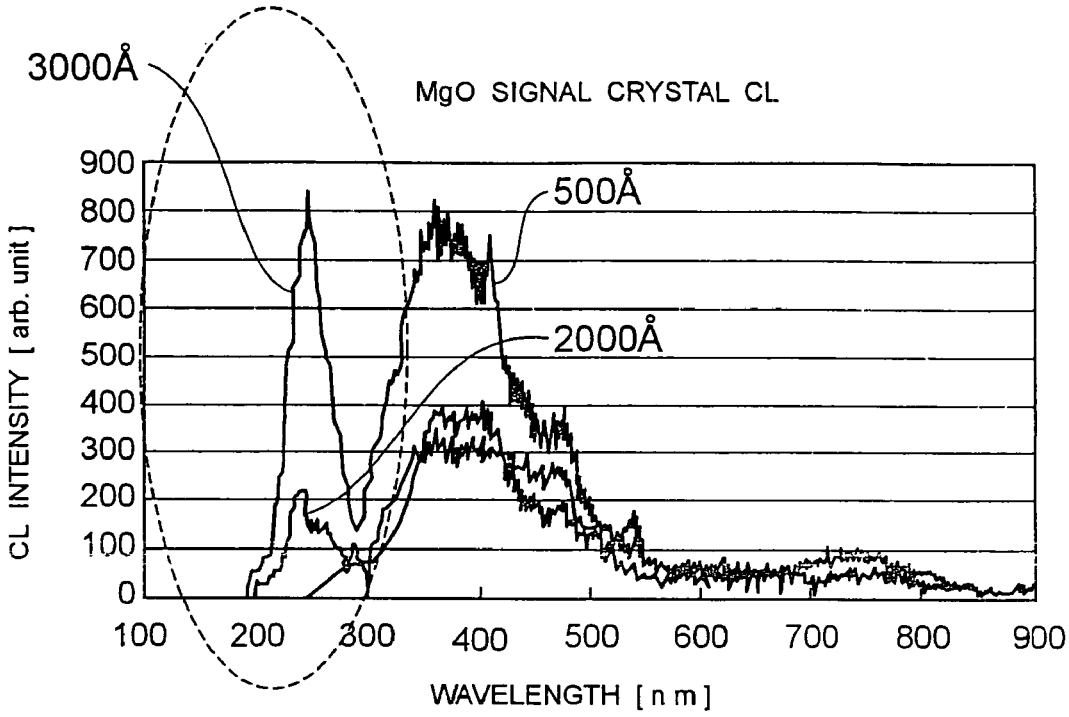
FIG. 10 is a graph showing the relationship between the grain diameter of magnesium oxide single crystal powder and the wavelength of CL light emission.
Figure 11:
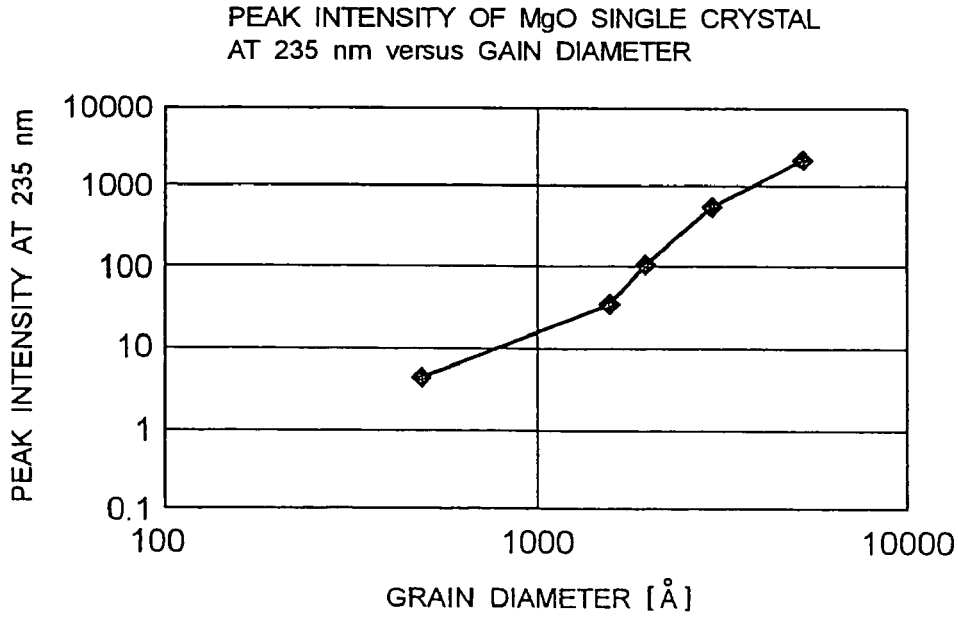
FIG. 11 is a graph showing the relationship between the grain diameter of magnesium oxide single crystal powder and the intensity of CL light emission of 235 nm.

As described above, the vapor-phase magnesium oxide single crystals included in the magnesium oxide layer 13 formed in each display cell PC are excited by an electron beam irradiated thereto to emit CL light having a peak in a wavelength range of 200-300 nm (particularly, near 235 nm in 230-250 nm), as shown in FIG. 10. In this event, as shown in FIG. 11, the emitted CL light having a peak at 235 nm exhibits a higher peak intensity as the vapor-phase based magnesium oxide single crystals have larger grain diameters. Specifically, when vapor-phase magnesium oxide crystals are produced, as magnesium is heated at temperatures higher than usual, single crystals having a relatively large grain diameters of 2000 angstroms or more, as shown in FIG. 5 or 6, are formed together with vapor-phase magnesium oxide single crystals having an average grain diameter of 500 angstroms. In this event, since the magnesium is heated at temperatures higher than usual, a flame associated with the reaction of magnesium with oxygen also becomes longer. Consequently, a larger temperature difference is produced between the flame and ambient, so that it is estimated that a group of magnesium oxide single crystals having larger diameters include more single crystals which exhibit high energy levels corresponding to 200-300 nm (particularly, 235 nm).

Figure 12:
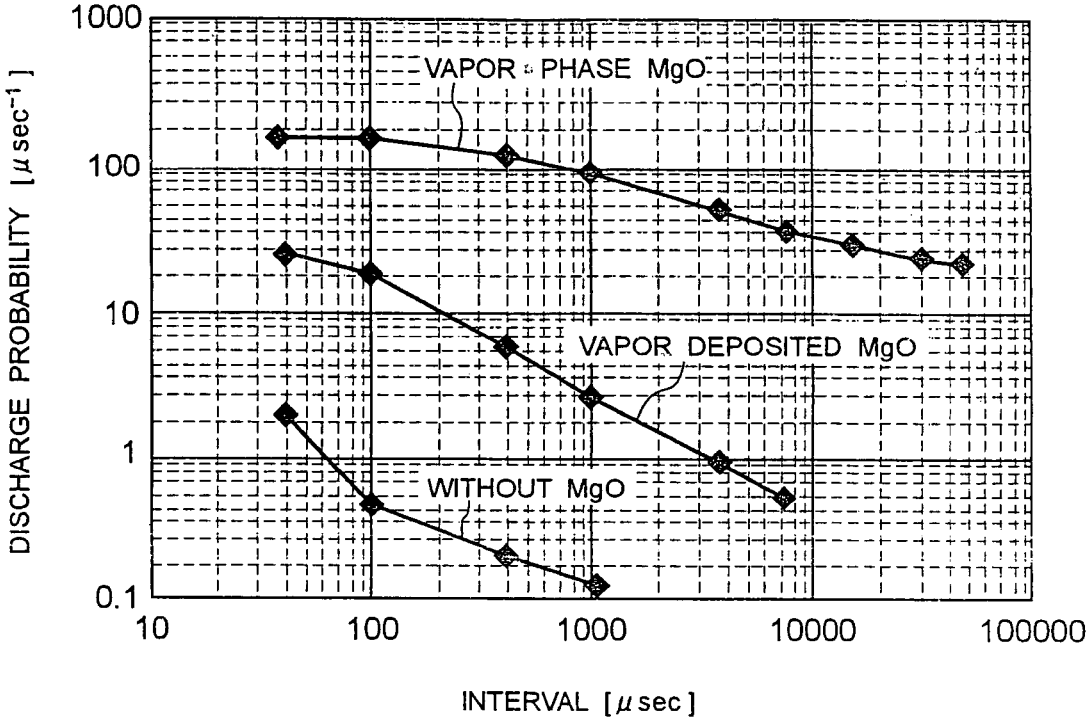
FIG. 12 is a diagram showing a discharge probability when no magnesium oxide layer is formed in a display cell PC, a discharge probability when a magnesium oxide layer is formed in accordance with a conventional vapor deposition method, and a discharge probability when a magnesium oxide layer is formed in a multiple crystal structure.

FIG. 12 is a diagram showing a discharge probability when a display cell PC is not formed therein with a magnesium oxide layer, a discharge probability when a display cell PC is formed therein with a magnesium oxide layer according to a conventional vapor deposition method, and a discharge probability when a display cell PC is formed with a magnesium oxide layer including magnesium oxide single crystals which involve the emission of CL light having a peak in a range of 200-300 nm (particularly, near 235 nm within 230-250 nm) with the irradiation of an electron beam. In FIG. 12, the horizontal axis represents a discharge interval, i.e., a time interval from the time a discharge is produced to the time the next discharge is produced.

Figure 13:
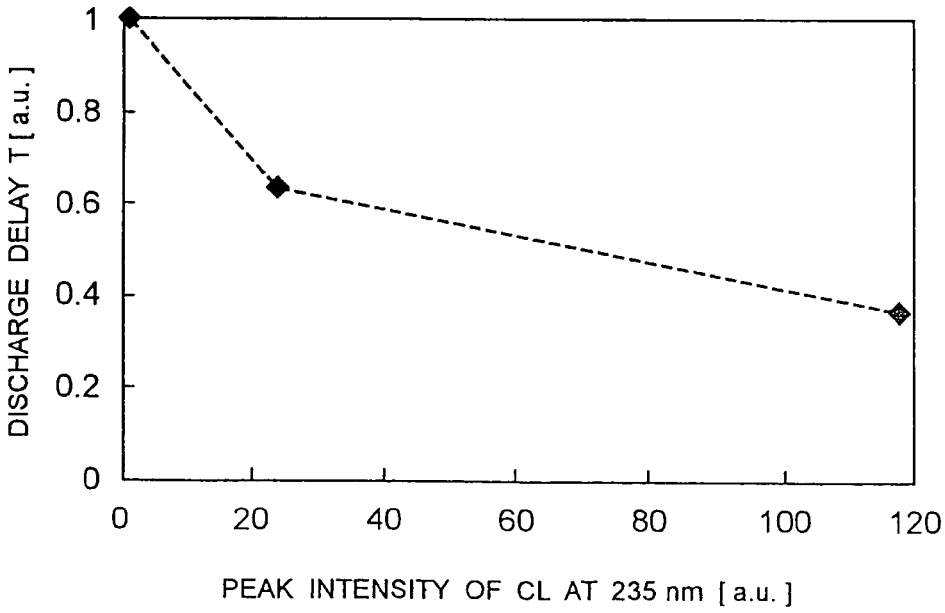
FIG. 13 is a diagram showing a correspondence relationship between the intensity of CL light emission, the peak of which is at 235 nm, and a discharge delay time.

As shown, when each display cell PC contains, in the discharge space S, the magnesium oxide layer 13 including magnesium oxide single crystals which involve the emission of CL light having a peak in a range of 200-300 nm (particularly, near 235 nm within 230-250 nm) with the irradiation of an electron beam, the discharge probability is increased as compared with the display cell PC having the magnesium oxide layer formed by a conventional vapor deposition method. As shown in FIG. 13, the vapor-phase magnesium oxide single crystals can reduce a delay in a discharge produced in the discharge space S as it has a higher intensity of the CL light emission, particularly, the CL light emission having a peak at 235 nm when they are irradiated with an electron beam.

Thus, even if the reset pulse $RP_Y$ applied to the row electrode Y is generated such that its voltage slowly changes as shown in FIG. 9 to produce a faint reset discharge with the intention to limit the light emission associated with the reset discharge not involved in displaying an image to improve the contrast, the faint reset discharge can be produced with stability for a short duration. Particularly, since each display cell PC employs the structure which causes a discharge to be locally produced near the discharge gap between the T-shaped transparent electrodes Xa, Ya, this structure contributes to the prevention of a sporadic reset discharge so strong as to produce a discharge across the overall row electrode, and also to the prevention of a strong erroneous discharge between the column electrode and the row electrode.

Also, since a higher discharge probability (shorter discharge delay) permits the priming effect by the writing reset discharge and the erase reset discharge in the reset stage R to last for a longer time, the address discharge produced in the addressing stage W and the sustain discharge produced in the sustain stage I become faster. This can reduce the pulse width Wa of each of the pixel pulse DP and the scan pulse SP to less than 1 μsec, as shown in FIG. 9, which are applied to the column electrode D and row electrode Y, respectively, to produce the address discharge, thus permitting a corresponding reduction in the processing time spent for the addressing stage W. Further, the faster address discharge and sustain discharge can reduce the pulse width Wb of the sustain pulse $IP_Y$, as shown in FIG. 9, which is applied to the row electrode to produce the sustain discharge, thus permitting a corresponding reduction in the processing time spent for the sustain stage I.

Consequently, an increased number of sub-fields can be provided in the one-field (or one-frame) display period by the reduction in the processing time spent for each of the addressing stage W and sustain stage I, thereby increasing the number of gradation levels.

While the PDP 50 in the above embodiment employs the structure which has the display cell PC formed between the row electrode X and the row electrode Y which form a pair, such as row electrode pairs $(X_1, Y_1)$, $(X_2, Y_2)$, $(X_3, Y_3)$, . . . , $(X_n, Y_n)$, the PDP 50 may employ a structure which has display cells PC formed between all row electrodes adjacent to each other. Specifically, in this possible structure, the display cells PC may be formed between the row electrodes $X_1$, $Y_1$, between the row electrodes $Y_1$, $X_2$; between the row electrodes $X_2$, $Y_2$, . . . , between the row electrodes $Y_{n-1}$, $X_n$, and between the row electrodes $X_n$, $Y_n$, respectively.

Further, while the PDP 50 in the above embodiment employs the structure which has the row electrodes X, Y formed on the front transparent substrate 10, and the column electrodes D and fluorescent material layer 17 formed on the back substrate 14, respectively, the PDP 50 may employ a structure which has the column electrodes D as well as the row electrodes X, Y formed on the front transparent substrate 10, and the fluorescent material layer 17 formed on the back substrate 14.

In addition, in the above embodiment, as the driving method for grayscale-driving the PDP 50, so-called selective write addressing in which all of the display cells are initialized (reset stage R) so that the potential across the paired row electrodes caused by the wall electric charge is less than a predetermined value, wall electric charge is selectively formed in each of the display cells on the basis of the input image signal, that is, wall electric charge is formed so that the potential across the paired row electrodes is equal to or more than a predetermined value (address stage W) was described. However, as the driving method for grayscale-driving the PDP 50, so-called selective erase addressing in which wall electric charge is formed in all of the display cells, that is, wall electric charge is formed so that the potential across the paired row electrodes is equal to or more than a predetermined value (reset stage R), wall electric charge formed within each of the display cells is selectively erased in accordance with the pixel data, that is, the potential across the paired row electrodes caused by the wall electric charge is less than a predetermined value (address stage W) may be adopted. When the selective erase addressing is adopted, shortening of the address period and sustain period can be achieved in the same way as the case where selective write addressing is adopted.

Furthermore, in the above embodiment, a constitution where a sustain stage is performed with respect to all the display lines after address scanning of all the display lines has been performed is exemplified. However, after address scanning of a plurality of display lines has been performed (each time the address scanning of a group of display lines has ended), a sustain stage for all the display lines may be performed.

As described above, according to the present invention, the plasma display device comprises a magnesium oxide layer which is formed on a plane in contact with the discharge space in each of the display cells and which includes magnesium oxide crystals that perform cathode luminescence light emission with a peak in a wavelength band of 200 to 300 nm as a result of excitation caused by electron-beam irradiation; address means for setting the display cells in a lit cell state or an unlit cell state by selectively inducing an address discharge in each of the display cells by applying a scan pulse to one row electrode of the row electrode pair and by applying a pixel data pulse that corresponds with pixel data based on an image signal to the column electrode; and sustain means that cause only the display cells set in the lit cell state to perform a sustain discharge by applying a sustain pulse to each of the row electrode pairs after the selective scanning of the plurality of display lines or all of the display lines has ended. It is therefore possible to shorten the respective address periods and sustain periods and, as a result, the number of display grayscales can be increased.

This application is based on Japanese Patent Application No. 2005-011631 which is hereby incorporated by reference.

What is claimed is:

1. A plasma display device equipped with a plasma display panel having a plurality of row electrode pairs constituting a plurality of display lines, a plurality of column electrodes formed on a back substrate, the plurality of column electrodes intersecting with each of the row electrode pairs so as to form display cells each having a discharge space at the intersection portions, and a dielectric layer formed on a front transparent substrate to cover the plurality of row electrode pairs, comprising:

a magnesium oxide layer formed by magnesium oxide crystals adhered onto the dielectric layer to face the discharge space in each of the display cells, the magnesium oxide crystals including magnesium oxide single crystals that have a characteristic to emit cathode luminescence light having a peak in a wavelength band of 200 to 300 nm when excited by electron-beam irradiation and that have a grain diameter of at least 2000 angstroms;

an address portion which sets the display cells in a lit cell state or an unlit cell state by selectively inducing an address discharge in each of the display cells by applying a scan pulse to one row electrode of each of the row electrode pairs in turn and by applying a pixel data pulse to the column electrode in accordance with pixel data based on an image signal; and a sustain portion which allows only the display cells set in the lit cell state to execute a sustain discharge by applying a sustain pulse to each of the row electrode pairs after the selective scanning of some of the display lines or all of the display lines by the address portion has ended.

2. The plasma display device according to claim 1, wherein the respective row electrodes constituting each of the row electrode pairs include a main body section extending in the row direction and protruding sections that protrude from the main body section in the column direction so that two protruding sections face each other via a discharge gap in each discharge space.

3. The plasma display device according to claim 2, wherein each of the protruding sections of the row electrodes includes a wider section located in the vicinity of the discharge gap and a narrow section for linking the wider section and the main body section.

4. The plasma display device according to claim 1, wherein the magnesium oxide single crystals are generated by subjecting magnesium vapor that is produced when heating magnesium to vapor-phase oxidation.

5. The plasma display device according to claim 1, wherein the magnesium oxide single crystals perform cathode luminescence light emission with a peak in a wavelength band of 230 to 250 nm.

6. The plasma display device according to claim 1, wherein the magnesium oxide layer is formed on a dielectric layer that covers each of the row electrode pairs.

7. The plasma display device according to claim 1, wherein the pulse width of the scan pulse is less than 1 μsec.

8. The plasma display device according to claim 1, wherein a discharge gas containing at least 10% by volume xenon is filled in the discharge space.

9. The plasma display device according to claim 1, wherein the magnesium oxide layer is formed through a thin-film magnesium oxide layer on a dielectric layer that covers each of the row electrode pairs.

10. The plasma display device according to claim 1, wherein the magnesium oxide single crystals each have a solid single crystal structure.

* * * * *